US005693897A

United States Patent [19]

Kita

[11] Patent Number: 5,693,897

[45] Date of Patent: Dec. 2, 1997

[54] COMPACTED CONSOLIDATED HIGH STRENGTH, HEAT RESISTANT ALUMINUM-BASED ALLOY

[75] Inventor: Kazuhiko Kita, Uozu, Japan

[73] Assignee: YKK Corporation, Tokyo, Japan

[21] Appl. No.: 605,711

[22] Filed: Feb. 22, 1996

Related U.S. Application Data

[63] Continuation of Ser. No. 152,233, Nov. 16, 1993, abandoned.

[30] Foreign Application Priority Data

Dec. 17, 1992 [JP] Japan ..... 4-337194
Apr. 9, 1993 [JP] Japan ..... 5-083422

[51] Int. Cl.[6] ..... C22C 21/00; B22F 1/00

[52] U.S. Cl. ..... 75/249; 148/437; 148/415; 420/551

[58] Field of Search ..... 148/403, 415, 148/437; 420/551; 75/249

[56] References Cited

U.S. PATENT DOCUMENTS

| | | | |
|---|---|---|---|
| 4,595,429 | 6/1986 | Le Caer et al. | 148/403 |
| 4,676,830 | 6/1987 | Inumaru et al. | 420/551 |
| 4,710,246 | 12/1987 | Le Caer et al. | 148/403 |
| 4,715,893 | 12/1987 | Skinner et al. | 148/403 |
| 4,734,130 | 3/1988 | Adam et al. | 148/437 |
| 5,053,085 | 10/1991 | Masumoto et al. | 148/403 |
| 5,221,375 | 6/1993 | Nagahora et al. | 148/403 |
| 5,279,642 | 1/1994 | Ohtera | 420/551 |

FOREIGN PATENT DOCUMENTS 0 171 798 2/1986 European Pat. Off. .

OTHER PUBLICATIONS

Patent Abstracts of Japan, vol. 15, No. 324, Aug. 19, 1991.
"Aluminium–Taschenbuch", 13th Edition, Aluminium–Verlag GMBH, Dusseldorf, Germany, 1974, pp. 936–937.

*Primary Examiner*—David A. Simmons
*Assistant Examiner*—Margery S. Phipps
*Attorney, Agent, or Firm*—Finnegan, Henderson, Farabow, Garrett & Dunner, L.L.P.

[57] ABSTRACT

A high strength, heat resistant aluminum-based alloy having a composition represented by the general formula $Al_{bal}Ti_aFe_b$ or the general formula $Al_{bal}Ti_aFe_bM_c$, wherein M represents at least one element selected from among V, Cr, Mn, Co, Y, Zr, Nb, Mo, Ce, La, Mm (misch metal), Hf, Ta and W; and a, b and c are, in weight percentage, $7 \leqq a \leqq 20$, $0.2 \leqq b \leqq 6$ and $0 < c \leqq 6$. A compacted and consolidated aluminum-based alloy having high strength and heat resistance is produced by melting a material having the above-specified composition, rapidly solidifying the melt into powder or flakes, compacting the resulting powder or flakes, and compressing, forming and consolidating the compacted powder or flakes by conventional plastic working.

10 Claims, 3 Drawing Sheets

COMPACTED CONSOLIDATED HIGH STRENGTH, HEAT RESISTANT ALUMINUM-BASED ALLOY

This application is a continuation of application Ser. No. 08/152,233, filed Nov. 16, 1993, now abandoned.

BACKGROUND OF THE INVENTION

1. Field of the Invention

The present invention relates to a high strength, heat resistant aluminum-based alloy having high strength, high ductility and high-temperature strength and to a compacted and consolidated aluminum-based alloy material produced by compacting and consolidating the alloy.

The present invention also relates to a process for producing the compacted and consolidated aluminum-based alloy material from the aluminum-based alloy.

2. Description of the Prior Art

An aluminum-based alloy having high strength and high heat resistance has heretofore been produced by the liquid quenching process or other similar processes. In particular, such a rapidly solidified aluminum-based alloy is disclosed in Japanese Patent Laid-Open No. 275732/1989. The aluminum-based alloy obtained by the liquid quenching process is an amorphous or microcrystalline alloy and is an excellent alloy having high strength, high heat resistance and high corrosion resistance.

Although the aluminum-based alloy disclosed in the Japanese Patent Laid-Open No. 275732/1989 is an excellent alloy having high strength, high heat resistance and high corrosion resistance and is excellent also in the workability when it is used as a high strength material, there is a room for an improvement when it is used as a material of which high toughness and high specific strength are required.

SUMMARY OF THE INVENTION

Accordingly, an object of the present invention is to provide a high strength aluminum-based alloy having high strength, excellent toughness while maintaining a strength applicable to a structural member required to have high reliability, and high-temperature strength and to provide a compacted and consolidated material produced therefrom.

Another object of the present invention is to provide a production process of the compacted and consolidated material.

Accordingly, a first aspect of the present invention is directed to a high strength, heat resistant aluminum-based alloy having a composition represented by the general formula:

$$Al_{bal}Ti_aFe_b$$

wherein a and b are, in weight percentage, $7 \leqq a \leqq 20$ and$0.2 \leqq b \leqq 6$.

A second aspect of the present invention is directed to a high strength, heat resistant aluminum-based alloy having a composition represented by the general formula:

$$Al_{bal}Ti_aFe_bM_c$$

wherein M represents at least one element selected from among V, Cr, Mn, Co, Y, Zr, Nb, Mo, Ce, La, Mm (misch metal), Hf, Ta and W; and a, b and c are, in weight percentage, $7 \leqq a \leqq 20$, $0.2 \leqq b \leqq 6$ and $0 < c \leqq 6$.

A third aspect of the present invention is directed to a compacted and consolidated aluminum-based alloy having high strength and heat resistance, which has been produced by compacting and consolidating a rapidly solidified material having a composition represented by the general formula:

$$Al_{bal}Ti_aFe_b$$

wherein a and b are, in weight percentage, $7 \leqq a \leqq 20$ and $0.2 \leqq b \leqq 6$.

A fourth aspect of the present invention is directed to a compacted and consolidated aluminum-based alloy having high strength and heat resistance, which has been produced by compacting and consolidating a rapidly solidified material having a composition represented by the general formula:

$$Al_{bal}Ti_aFe_bM_c$$

wherein M represents at least one element selected from among V, Cr, Mn, Co, Y, Zr, Nb, Mo, Ce, La, Mm (misch metal), Hf, Ta and W; and a, b and c are, in weight percentage, $7 \leqq a \leqq 20$, $0.2 \leqq b \leqq 6$ and $0 < c \leqq 6$.

The above-described consolidated aluminum-based alloy materials are composed of a matrix of aluminum or a supersaturated aluminum solid solution, whose average crystal grain size is 40 to 2000 nm, and, homogeneously distributed in the matrix, particles made of a stable phase or a metastable phase of various intermetallic compounds formed from the matrix element and other alloying elements and/or various intermetallic compounds formed from other alloying elements themselves, the intermetallic compounds having a mean particle size of 10 to 1000 nm.

Further, the present invention also provides a process for the production of the compacted and consolidated aluminum-based alloy material having high strength and heat resistance, the process comprising:

melting a material having a composition represented by either one of the aforesaid formulae;

rapidly solidifying the melt into powder or flakes;

compacting the resulting powder or flakes; and compressing, forming and consolidating the compacted powder or flakes by conventional plastic working.

In this case, the powder or flake as the raw material should be composed of any one of an amorphous phase, a solid solution phase and a microcrystalline phase such that the mean grain size of the matrix is 2000 nm or less and the mean particle size of intermetallic compounds is 10 to 1000 nm or a mixed phase thereof. When the raw material is composed of an amorphous phase, the material may be converted into such a microcrystalline phase or a mixed phase by heating it to a temperature of 50° to 400° C. upon compaction.

The above-described conventional plastic working means should be interpreted in a broad sense and includes also press forming and powder metallurgy techniques.

DETAILED DESCRIPTION OF THE PREFERRED EMBODIMENTS

Figure 1:
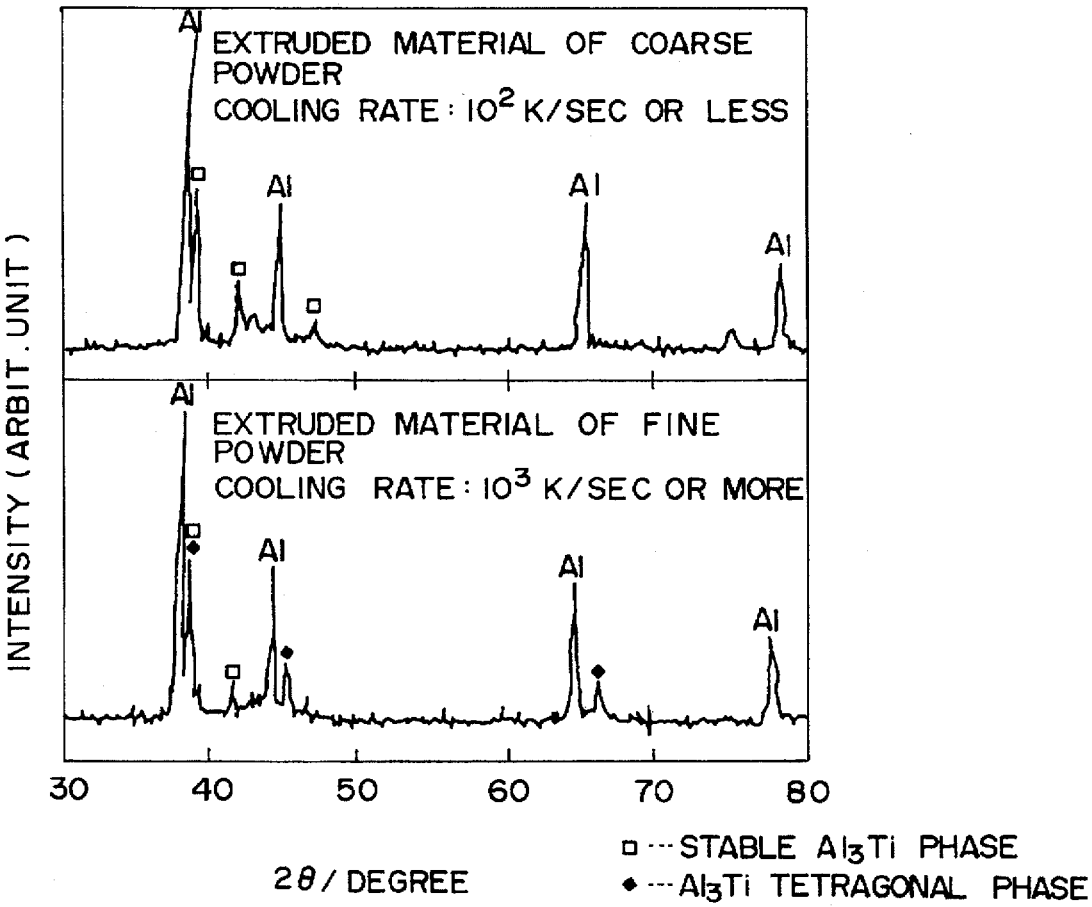
FIG. 1 is X-ray diffraction diagrams of coarse powder and fine powder prepared in Example 2.

The aluminum-based alloy of the present invention can be produced through the rapid solidification of a molten metal of an alloy having the above-described composition by the liquid quench process. The liquid quench process is a process wherein a molten alloy is rapidly cooled and, for example, the single-roller melt-spinning process, twin-roller melt-spinning process, in-rotating-water melt-spinning process, etc., are particularly useful. In these processes, a cooling rate of about $10^2$ to $10^8$ K/sec can be attained. In producing a thin ribbon material by the single-roller melt-spinning process, twin-roller melt-spinning process or the like, a molten metal is injected through a nozzle into, for example, a copper or steel roll having a diameter of 30 to 300 mm and rotating at a constant speed in the range of from about 300 to 10000 rpm. Thus, various thin ribbon materials having a width of about 1 to 300 mm and a thickness of about 5 to 500 μm can be easily produced. On the other hand, a fine wire material can be easily produced by the in-rotating-water melt-spinning process by injecting a molten metal by means of a back pressure of an argon gas through a nozzle into a liquid cooling medium layer having a depth of about 1 to 10 cm held by means of a centrifugal force within a drum rotating at about 50 to 500 rpm. In this case, the angle of the molten metal ejected through the nozzle to the cooling medium surface is preferably about 60° to 90°, while the relative speed ratio of the ejected molten metal to the liquid cooling medium surface is preferably 0.7 to 0.9.

Instead of using the above-described processes, a thin film can be produced by sputtering, and a quenched powder can be produced by various atomization processes, such as a high pressure gas spraying process, or a spray process.

The alloy of the present invention can be produced by the above-described single-roller melt-spinning process, twin-roller melt-spinning process, in-rotating-water melt spinning process, sputtering, various atomization processes, spray process, mechanical alloying process, mechanical grinding process, etc. Further, if necessary, the mean crystal grain size of the matrix and the mean particle size of the intermetallic compound particles can be controlled by suitably selecting the production conditions.

Further, although some compositions can provide an amorphous structure, the resultant structure may be converted into a crystalline structure by heating to a certain temperature or higher. By this thermal conversion of the amorphous structure, the alloy of the present invention can also be obtained and in this case, the mean crystal grain size and the intermetallic compound particle size can be controlled by suitably selecting the heating conditions.

In the aluminum-based alloy having a composition represented by either one of the above-defined general formulae and the compacted and consolidated aluminum-based alloy material prepared therefrom, when "a", "b" and "c" are limited, by weight percentage, to the ranges of 7 to 20%, 0.2 to 6% and more than 0% to 6%, respectively, because the alloys within the above ranges have a higher strength than conventional (commercial) high-strength aluminum alloys throughout the temperature range of from room temperature to 400° C. and are also equipped with ductility sufficient to withstand practically employed working.

Especially, when Cr is selected as M in the general formula of the second and fourth inventions, the total of Fe and Cr is preferably from 4 to 10% and the Fe/Cr ratio is preferably from 0.2 to 10, respectively. The limitation of the total amount of Fe and Cr to the range of 4 to 10% can provide alloys having more superior heat resistance properties and make possible the formation of a proper quantity of dispersed intermetallic compounds, strengthening the resultant structure and facilitating the plastic deformation of the resultant material. The limitation of the Fe/Cr ratio to 0.2 to 10 can provide a further refined structure and improve the heat resistance due to the coexistence of both elements in amounts of at least the specified minimum levels. The thus obtained consolidated material has a tensile strength of at least 65 kgf/mm$^2$ at room temperature and a tensile strength of at least 20 kgf/mm$^2$ at 300° C. Further, the consolidated material has an elastic modulus of at least 8000 kgf/mm$^2$ at room temperature.

In the aluminum-based alloy and the compacted and consolidated aluminum-based alloy material of the present invention, Fe element is an element having a small diffusibility in the Al matrix and forms various metastable or stable intermetallic compounds, which contributes to the stabilization of the resultant fine crystalline structure. Especially, an Fe addition in the range of 0.2 to 6 wt. % provides improvements in the elastic modulus and high-temperature strength. An Fe addition exceeding 6.0% by weight adversely affects the ductility of the alloy at room temperature. Further, Ti element is an element having a relatively small diffusibility in the Al matrix and, when Ti is finely dispersed as an intermetallic compound in the Al matrix, it exhibits an effect in strengthening the matrix and inhibiting the growth of crystal grains. Thus, it can remarkably improve the hardness, strength and rigidity of the alloy and the consolidated material and stabilize the finely crystalline phase not only at room temperature but also at high temperatures, thus imparting heat resistance.

The M element is at least one element selected from among V, Cr, Mn, Co, Y, Zr, Nb, Mo, Ce, La, Mm (misch metal), Hf, Ta and W and these elements have a small diffusibility in the Al matrix to form various metastable or stable intermetallic compounds which contribute to the stabilization of the fine crystalline structure at high temperatures.

In the consolidated material of an aluminum-based alloy according to the present invention, the mean crystal grain size of the matrix is preferably limited to 40 to 2000 nm, because when it is less than 40 nm, the strength is high but the ductility is insufficient, while when it exceeds 2000 nm, the strength lowers. The mean particle size of the intermetallic compounds is preferably limited to 10 to 1000 nm, because when it is outside the range, the intermetallic compounds do not serve as an element for strengthening the Al matrix. Specifically, when the mean particle size is less than 10 nm, the intermetallic compounds do not contribute to the strengthening of the Al matrix, and when the intermetallic compounds are excessively dissolved in the solid solution form in the matrix, there is a possibility that the material becomes brittle. On the other hand, when the mean particle size exceeds 1000 nm, the size of the dispersed particles becomes too large to maintain the strength and the intermetallic compounds cannot serve as a strengthening element. When the mean particle size is in the above-described range, it becomes possible to improve the Young's modulus, high-temperature strength and fatigue strength.

In the compacted and consolidated aluminum-based alloy material of the present invention, the mean crystal grain size and the state of dispersion of the intermetallic compounds can be controlled through proper selection of the production conditions. When importance is given to the strength, the mean crystal grain size of the matrix is controlled so as to become small. On the other hand, when importance is given to the ductility, the mean crystal grain size of the matrix and the mean particle size of the intermetallic compounds are controlled so as to become large. Thus, compacted and consolidated materials suitable for various purposes can be produced.

Further, when the mean crystal grain size of the matrix is controlled so as to fall within the range of from 40 to 1000 nm, it becomes possible to impart excellent properties as a superplastic working material at a strain rate in the range of $10^{-2}$ to $10^{2}$ $S^{-1}$.

Inclusion of B and C not exceeding 1% by weight does not deteriorate the strength properties and heat resistance. Also, the presence of Si of 2% by weight or less does not deteriorate the strength properties and heat resistance. An addition of Ni in an amount of not more than 1% by weight effectively serves to improve the strength and ductility.

The present invention will now be described in more detail with reference to the following Examples.

EXAMPLE 1

Aluminum-based alloy powders having the predetermined compositions were prepared at an average cooling rate of $10^{3}$ K/sec, using a gas atomizing apparatus. The aluminum-based alloy powders thus produced were filled into a metallic capsule and, while being degassed, were formed into billets for extrusion by a vacuum hot-pressing. These billets were extruded at a temperature of 300° to 550° C. by an extruder.

40 Kinds of consolidated materials (extruded materials) having the respective compositions (weight percentage) specified in the left columns of Tables 1 and 2 were produced under the above-mentioned production conditions in the right columns of Tables 1 and 2.

The above consolidated materials were subjected to measurements of tensile strength at room temperature, Young's modulus (elastic modulus) at room temperature and hardness at room temperature and tensile strength at an elevated temperature of 300° C., as shown in the right columns of Tables 1 and 2.

It can be seen from the results in Table 1 that the consolidated materials of the present invention have superior properties over a conventional (commercial) high-strength aluminum alloy (super duralmin) having a tensile strength of 500 MPa at room temperature and 100 MPa at 300° C. Further, the consolidated materials of the present invention also have superior Young's modulus as opposed to about 7000 kgf/mm$^2$ of the conventional commercial high-strength aluminum alloy (duralmin) and because of their high Young's modulus, they exhibit an effect of reducing their deflection or deformation amount as compared with that of the conventional material when the same load is applied to them. Consequently, it can be clear that the consolidated materials of the present invention are excellent in the tensile strength, hardness and Young's modulus.

The hardness values were obtained by measuring with a microVickers hardness tester under a load of 25 g. The consolidated materials listed in Tables 1 and 2 were subjected to measurement of the elongation at room temperature to reveal that the elongation exceeds the minimum elongation (2%) necessary for general working. Test pieces for observation under TEM were cut out of the consolidated materials (extruded materials) produced under the above-described production conditions and observation was conducted to determine the crystal grain size of their matrix and particle size of the intermetallic compounds. All the samples were composed of a matrix of aluminum or a supersaturated aluminum solid solution having a mean crystal grain size of 40 to 2000 nm and, homogeneously distributed in the matrix, particles made of a stable phase or a metastable phase of various intermetallic compounds formed from the matrix element and other alloying elements and/or various intermetallic compounds formed from other alloying elements themselves, the intermetallic compounds having a mean particle size of 10 to 1000 nm.

TABLE 1

| Invention | Composition (wt. %) | | | Tensile strength at room tem. | Young's modulus | Hardness | Tensile strength at 300° C. |
|---|---|---|---|---|---|---|---|
| sample No. | Al | Ti | Fe | (MPa) | (GPa) | (Hv) | (MPa) |
| 1 | balance | 7 | 2.1 | 818 | 89 | 221 | 310 |
| 2 | balance | 7 | 1.3 | 883 | 86 | 235 | 323 |
| 3 | balance | 8 | 3.2 | 845 | 85 | 216 | 326 |
| 4 | balance | 8 | 4.5 | 851 | 84 | 200 | 316 |
| 5 | balance | 9 | 3.8 | 865 | 81 | 211 | 329 |
| 6 | balance | 9 | 3.5 | 812 | 81 | 193 | 332 |
| 7 | balance | 10 | 0.2 | 861 | 89 | 152 | 326 |
| 8 | balance | 10 | 1.8 | 841 | 87 | 161 | 328 |
| 9 | balance | 11 | 2.2 | 825 | 86 | 185 | 331 |
| 10 | balance | 11 | 3.1 | 856 | 82 | 216 | 316 |
| 11 | balance | 12 | 2.7 | 811 | 87 | 224 | 326 |
| 12 | balance | 12 | 3.0 | 869 | 91 | 212 | 341 |
| 13 | balance | 13 | 2.2 | 908 | 89 | 197 | 345 |
| 14 | balance | 13 | 4.8 | 848 | 81 | 184 | 331 |
| 15 | balance | 14 | 4.6 | 888 | 88 | 222 | 346 |
| 16 | balance | 15 | 3.9 | 846 | 91 | 232 | 331 |
| 17 | balance | 16 | 2.5 | 931 | 95 | 219 | 335 |
| 18 | balance | 17 | 3.4 | 899 | 91 | 215 | 346 |
| 19 | balance | 18 | 2.0 | 816 | 84 | 234 | 316 |
| 20 | balance | 19 | 1.0 | 986 | 96 | 241 | 321 |

TABLE 2

| Invention sample No. | Composition (wt. %) Al | Ti | Fe | M | Tensile strength at room temp. (MPa) | Young's modulus (GPa) | Hardness (Hv) | Tensile strength at 300° C. (MPa) |
|---|---|---|---|---|---|---|---|---|
| 1 | balance | 7 | 1.1 | V = 2.3 | 836 | 88 | 221 | 311 |
| 2 | balance | 7 | 2.0 | Cr = 2.2<br>Mn = 2.4 | 871 | 85 | 215 | 327 |
| 3 | balance | 8 | 3.0 | Mn = 1.7 | 832 | 83 | 219 | 331 |
| 4 | balance | 8 | 3.5 | Co = 2.3 | 869 | 85 | 214 | 319 |
| 5 | balance | 9 | 4.2 | La = 2.4 | 855 | 82 | 219 | 339 |
| 6 | balance | 9 | 4.7 | Y = 4.8 | 832 | 81 | 183 | 312 |
| 7 | balance | 10 | 1.2 | V = 2.3<br>Zr = 2.5 | 867 | 90 | 177 | 336 |
| 8 | balance | 10 | 1.9 | Nb = 3.0 | 843 | 86 | 181 | 318 |
| 9 | balance | 11 | 3.2 | Co = 2.3<br>Mo = 1.8 | 835 | 87 | 195 | 315 |
| 10 | balance | 11 | 4.1 | Hf = 1.7 | 866 | 85 | 217 | 337 |
| 11 | balance | 12 | 0.7 | Ta = 3.5 | 831 | 86 | 214 | 331 |
| 12 | balance | 12 | 1.0 | W = 2.3 | 879 | 93 | 232 | 331 |
| 13 | balance | 13 | 3.2 | V = 3.5 | 909 | 88 | 196 | 339 |
| 14 | balance | 13 | 4.1 | Cr = 2.6 | 858 | 88 | 187 | 328 |
| 15 | balance | 14 | 2.3 | Co = 1.5<br>Zr = 1.7 | 878 | 87 | 191 | 339 |
| 16 | balance | 15 | 3.9 | Zr = 3.5 | 847 | 93 | 251 | 341 |
| 17 | balance | 16 | 0.5 | W = 2.5 | 911 | 94 | 234 | 345 |
| 18 | balance | 17 | 0.4 | Mn = 1.5<br>Mm = 0.5 | 909 | 93 | 226 | 336 |
| 19 | balance | 18 | 1.0 | V = 3.6 | 836 | 84 | 226 | 316 |
| 20 | balance | 19 | 2.0 | Cr = 3.5<br>Ce = 1.0 | 936 | 96 | 249 | 321 |

EXAMPLE 2

Aluminum-based alloy powders having the composition $Al_{83.5}Ti_{10}Fe_5Cr_{1.5}$ were prepared using a gas atomizing apparatus in which one type of the powder was fine powder prepared at a cooling rate of at least $10^3$ K/sec and the other one was coarse powder prepared at a cooling rate of not more than $10^2$ K/sec. The aluminum-based alloy powders thus produced were formed into consolidated materials (extruded materials) in the same manner as described in Example 1.

Test pieces were prepared from the respective consolidated material and subjected to measurements of tensile strength and yield strength. The consolidated material composed of the fine powder prepared at the cooling rate of $10^3$ K/sec or higher had a tensile strength of 71 kgf/mm$^2$ (710 MPa) and a yield strength of 60 kgf/mm$^2$ (600 MPa). The consolidated material composed of the coarse powder prepared at the cooling rate of $10^2$ K/sec or less had a tensile strength of 58 kgf/mm$^2$ (580 MPa) and a yield strength of 47 kgf/mm$^2$ (470 MPa).

As is apparent from the above results, alloy powders having superior strength and yield strength can be obtained by preparing fine powders at a cooling rate of at least $10^3$ K/sec. Compacted and consolidated materials having superior strength and yield strength can be obtained from by compacting and consolidating the fine alloy powders. The respective test pieces were examined by X-ray diffraction and the results are shown in FIG. 1. It is clear from FIG. 1 that compounds (tetragonal $Al_3Ti$ having the structure shown in Table 3) corresponding to peaks marked by ● are precipitated in the fine powders prepared at the cooling rate of at least $10^3$ K/sec and the compounds contribute to the above-mentioned improved strength and yield strength.

TABLE 3

| Calculated X-ray diffraction data of tetragonal $Al_3Ti$ phase | | |
|---|---|---|
| X-ray Diffraction Data | | |
| Atom position of Al | | |
| X | Y | Z |
| 0 | 0.5 | 0.5 |
| 0.5 | 0 | 0.5 |
| 0.5 | 0.5 | 0 |
| Atom position of Ti | | |
| X | Y | Z |
| 0 | 0 | 0 |

Wavelength = 0.154056 nm
a = 0.40000 nm, b = 0.40000 nm, c = 0.395000 nm
Alpha = 0.0000, Beta = 0.0000, Gamma = 0.0000

Similarly to Example 2, a stable phase of $Al_3Ti$ and a tetragonal $Al_3Ti$ phase were precipitated in the alloys prepared in Example 1.

EXAMPLE 3

Consolidated materials were obtained from materials having the respective compositions shown in Table 4 in the same manner as described in Example 1. The thus obtained materials were subjected the same tests as described in Example 1. The results are shown in Table 4.

Figure 2:
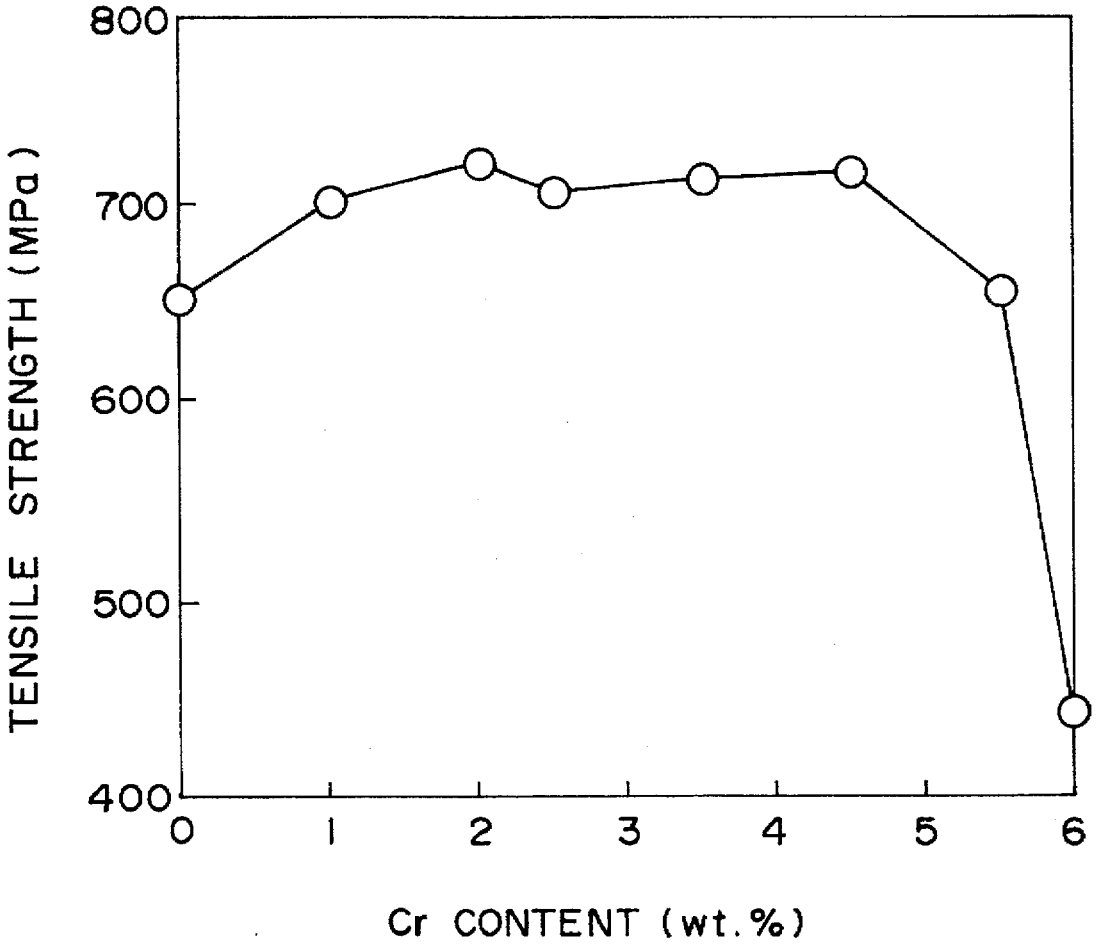
FIG. 2 is a graph showing the relationship between the chromium content (x) and the tensile strength at room temperature for a consolidated material represented by the general formula $Al_{bal}Ti_{9.8}Fe_{6.0-x}Cr_x$.
Figure 3:
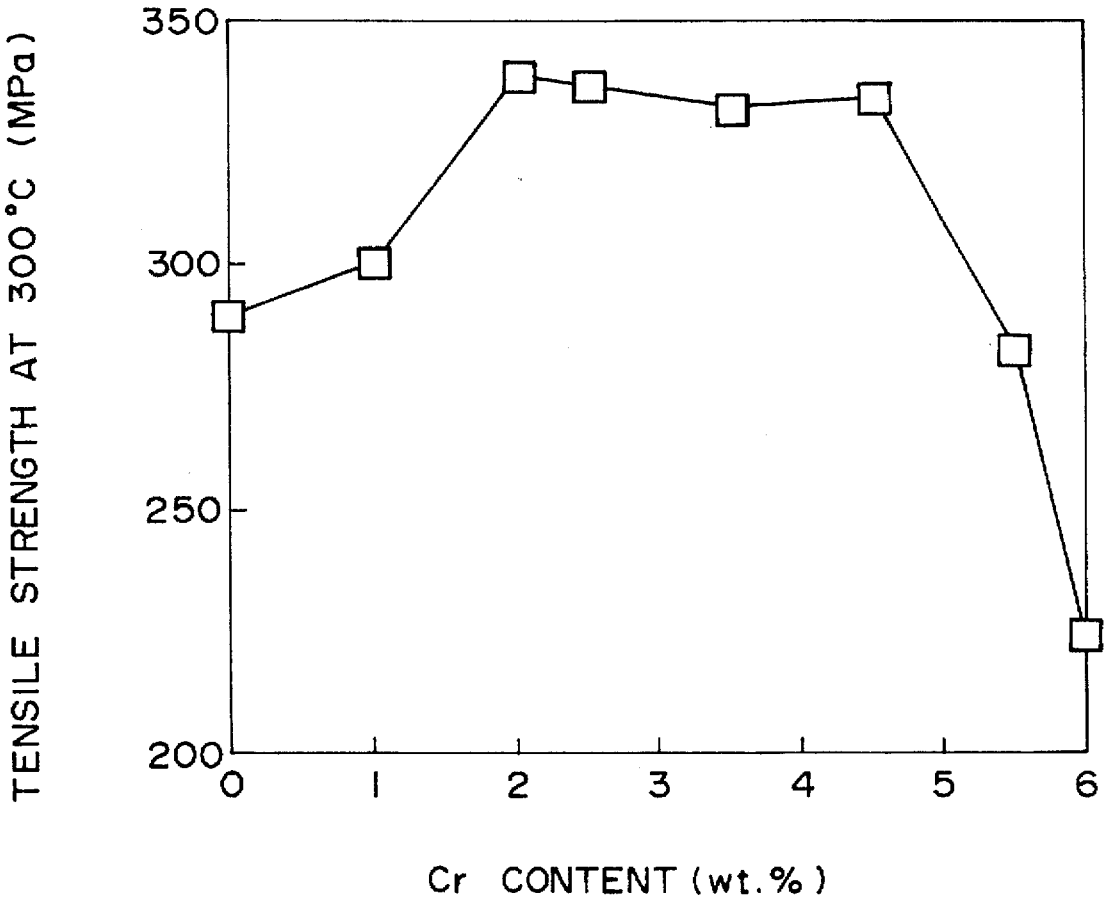
FIG. 3 is a graph showing the relationship between the chromium content (x) and the tensile strength at 300° C. for the same consolidated material.

With respect to the consolidated material having the general formula $Al_{bal}Ti_{9.8}Fe_{6.0-x}Cr_x$, the relationship between the x value (chromium content percentage) in the formula and the tensile strength at room temperature is shown in FIG. 2. Similarly, FIG. 3 shows relationship between the x value in the formula and the tensile strength at 300° C. for the same consolidated material.

TABLE 4

| Invention sample No. | Composition (wt. %) Al | Ti | Fe | Cr | Tensile strength at room temp. (MPa) | Young's modulus (GPa) | Tensile strength at 300° C. (MPa) |
|---|---|---|---|---|---|---|---|
| 1 | balance | 7 | 0.95 | 4.8 | 828 | 83 | 321 |
| 2 | balance | 7 | 1.1 | 4.2 | 863 | 88 | 334 |
| 3 | balance | 8 | 1.3 | 3.6 | 839 | 86 | 336 |
| 4 | balance | 8 | 1.5 | 4.3 | 863 | 83 | 327 |
| 5 | balance | 9 | 2.1 | 4.0 | 834 | 80 | 338 |
| 6 | balance | 9 | 2.3 | 3.9 | 803 | 79 | 346 |
| 7 | balance | 9 | 2.5 | 3.5 | 867 | 88 | 338 |
| 8 | balance | 9 | 3.1 | 2.9 | 853 | 86 | 339 |
| 9 | balance | 9 | 4.6 | 1.8 | 826 | 83 | 347 |
| 10 | balance | 9 | 4.8 | 1.7 | 859 | 85 | 336 |
| 11 | balance | 10 | 4.9 | 1.6 | 871 | 86 | 346 |
| 12 | balance | 10 | 5.1 | 1.0 | 896 | 89 | 339 |
| 13 | balance | 11 | 5.5 | 0.9 | 912 | 90 | 356 |
| 14 | balance | 12 | 5.8 | 0.7 | 838 | 93 | 348 |
| 15 | balance | 13 | 6.0 | 0.7 | 878 | 98 | 351 |

As described above, since the aluminum-based alloys of the present invention and the compacted and consolidated materials produced therefrom have not only superior strength over a wide temperature range of from room temperature to elevated temperatures, but also an excellent workability by virtue of their high toughness and high elastic modulus, they are useful as structural materials of which high reliability is required. The compacted and consolidated materials having the above-mentioned superior properties can be produced by the production process of the present invention.

What is claimed is:

1. An aluminum-based alloy having high strength and heat resistance, which has been produced by compacting and consolidating a rapidly solidified material consisting essentially of a composition represented by the general formula:

$$Al_{bal}Ti_aFe_b$$

wherein a and b are, in weight percentage, $7 \leqq a \leqq 20$ and $0.2 \leqq b \leqq 6$;

said compacted and consolidated alloy consisting of a matrix consisting essentially of aluminum with an average crystal grain size of 40 to 2000 nm, and particles uniformly distributed in the matrix, wherein said particles consist essentially of a stable $Al_3Ti$ phase, a tetragonal $Al_3Ti$ phase, and, optionally, one or more additional compounds selected from stable intermetallic compounds and metastable intermetallic compounds, and wherein said particles have a mean particle size of 10 to 1000 nm and said aluminum alloy has a room temperature tensile strength of 71 kgf/mm$^2$ or higher.

2. A compacted and consolidated aluminum-based alloy material according to claim 1, wherein the compacted and consolidated aluminum-based alloy material has an elastic modulus of at least 8000 kgf/mm$^2$ at room temperature and a strength of at least 20 kgf/mm$^2$ at 300° C.

3. A compacted and consolidated aluminum-based alloy according to claim 1, wherein the compacted and consolidated aluminum based alloy has a high temperature strength of at least 31 kgf/mm$^2$ at 300° C.

4. The alloy of claim 1 wherein said aluminum matrix comprises a supersaturated aluminum solid solution.

5. The aluminum-based alloy of claim 1, wherein said aluminum alloy has a room temperature tensile strength of 803 MPa or higher.

6. A compacted and consolidated aluminum-based alloy having high strength and heat resistance, which has been produced by compacting and consolidating a rapidly solidified material consisting essentially of a composition represented by the general formula:

$$Al_{bal}Ti_aFe_bM_c$$

wherein M represents at least one element selected from the group consisting of: V, Cr, Mn, Co, Y, Zr, Nb, Mo, Ce, La, Mm (misch metal), Hf, Ta and W; and wherein a, b and c are, in weight percentage, $7 \leqq a \leqq 20$, $0.2 \leqq b \leqq 6$ and $0 \leqq c \leqq 6$;

said alloy consisting of a matrix consisting essentially of aluminum having an average crystal grain size of 40 to 2000 nm, and particles uniformly distributed in the matrix, wherein said particles consist essentially of a stable $Al_3Ti$ phase, a tetragonal $Al_3Ti$ phase, and, optionally, one or more additional compounds selected from stable intermetallic compounds and metastable intermetallic compounds, and wherein said particles have a mean particle size of 10 to 1000 nm and said aluminum alloy has a room temperature tensile strength of 71 kgf/mm$^2$ or higher.

7. A compacted and consolidated aluminum-based alloy material according to claim 6, wherein the compacted and consolidated aluminum-based alloy material has an elastic modulus of at least 8000 kgf/mm$^2$ at room temperature and a strength of at least 20 kgf/mm$^2$ at 300° C.

8. A compacted and consolidated aluminum-based alloy according to claim 6, wherein the compacted and consolidated aluminum based alloy has a high temperature strength of at least 31 kgf/mm$^2$ at 300° C.

9. The alloy of claim 6 wherein said aluminum matrix comprises a supersaturated aluminum solid solution.

10. The compacted and consolidated aluminum-based alloy of claim 6, wherein said aluminum alloy has a room temperature tensile strength of 803 MPa or higher.

* * * * *